US009054426B2

(12) United States Patent
Soekawa

(10) Patent No.: US 9,054,426 B2
(45) Date of Patent: Jun. 9, 2015

(54) RADIO APPARATUS AND ANTENNA DEVICE

(75) Inventor: Kouji Soekawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 745 days.

(21) Appl. No.: 13/239,994

(22) Filed: Sep. 22, 2011

(65) Prior Publication Data

US 2012/0119963 A1 May 17, 2012

(30) Foreign Application Priority Data

Nov. 11, 2010 (JP) ..... 2010-252779

(51) Int. Cl.

| | |
|---|---|
| ***H01Q 1/24*** | (2006.01) |
| ***H01Q 1/38*** | (2006.01) |
| ***H01Q 13/10*** | (2006.01) |
| ***H01Q 1/36*** | (2006.01) |
| ***H01Q 1/48*** | (2006.01) |

(52) U.S. Cl.

CPC ..... *H01Q 13/10* (2013.01); *H01Q 1/243* (2013.01); *H01Q 1/36* (2013.01); *H01Q 1/48* (2013.01)

(58) Field of Classification Search

CPC ..... H01Q 1/38; H01Q 13/106; H01Q 1/243; H01Q 1/36; H01Q 1/48; H01Q 13/10

USPC ..... 343/702, 725, 767, 770, 726, 729

See application file for complete search history.

(56) References Cited

U.S. PATENT DOCUMENTS

| | | | | |
|---|---|---|---|---|
| 6,424,300 | B1 * | 7/2002 | Sanford et al. | 343/702 |
| 6,600,448 | B2 | 7/2003 | Ikegaya et al. | |
| 7,053,848 | B2 | 5/2006 | Shoji et al. | |
| 7,132,991 | B1 * | 11/2006 | Li et al. | 343/767 |
| 7,916,090 | B2 * | 3/2011 | Nysen | 343/702 |
| 2010/0060530 | A1 | 3/2010 | Shoji | |

FOREIGN PATENT DOCUMENTS

| | | | |
|---|---|---|---|
| JP | 2000-196342 | A | 7/2000 |
| JP | 2003-37431 | A | 2/2003 |
| JP | 2004-32303 | A | 1/2004 |
| JP | 2004-56421 | A | 2/2004 |
| JP | 2010-62976 | A | 3/2010 |

OTHER PUBLICATIONS

Japanese Office Action dated Mar. 11, 2014, issued in Japanese Patent Application No. 2010-252779, w/partial English translation, (3 pages).

Massey, J.P. et al., "Making Quarter Wavelength Notch Antennas Wideband," PIERS Online, 2007, pp. 984-986, vol. 3, No. 7.

* cited by examiner

*Primary Examiner* — Michael C Wimer

(74) *Attorney, Agent, or Firm* — Westerman, Hattori, Daniels & Adrian, LLP

(57) ABSTRACT

There is provided a radio apparatus which includes an antenna device and a housing to which the antenna device is attached. The antenna device includes a substrate includes an electrically conductive layer with a slit. The slit is formed at an end of the electrically conductive layer so that the slit includes an opening end. The antenna element is electrically coupled with the electrically conductive layer across the opening end via a matching circuit, and receives an electric power through one end of the antenna element.

12 Claims, 15 Drawing Sheets

$$l = la + lb$$
$$= la + (lx + ly)$$
$$\cong \lambda / 4$$

RADIO APPARATUS AND ANTENNA DEVICE

CROSS-REFERENCE TO RELATED APPLICATION

This application is based upon and claims the benefit of priority of the prior Japanese Patent Application No. 2010-252779, filed on Nov. 11, 2010, the entire contents of which are incorporated herein by reference.

FIELD

The embodiments discussed herein are related to a radio apparatus and an antenna device used in the radio apparatus.

BACKGROUND

Recently, a mobile radio terminal such as a mobile phone increases its functionality. The increase of the functionality requires the mobile radio terminal, to include various antennas depending on services provided such as one seg (Japanese terrestrial digital broadcasting service for mobile devices), the Global Positioning System (GPS), Bluetooth (registered trademark), a wireless Local Area Network (LAN), and a Frequency Modulation (FM) transmitter, in addition to a cellular antenna. A monopole antenna has been disposed in mobile radio terminals. In a monopole antenna, a substrate functioning as the ground (GND) is a part of the antenna. Accordingly, even if an antenna element is small, a large gain may be obtained with the size of a substrate. A monopole antenna is therefore suitable for a small apparatus such as a mobile radio terminal.

In order to obtain a good characteristic of a monopole antenna, it is desired that an antenna element is mounted as far as possible from the substrate, that is, the monopole antenna is usually disposed at a corner of a housing of the mobile radio terminal. However, when many antennas, such as ones described above, are disposed in a mobile radio terminal, it is difficult to dispose all of these antennas at the corner.

Since the Multiple Input Multiple Output (MIMO) technique is employed in Long Term Evolution (LTE) that is the following-generation communication standard, a sub-antenna designed for reception is further needed. Accordingly, a space required for placement of various antennas may be becoming insufficient. As a technique for solving the space for placement, it has been proposed that antennas may be configured without a conflict between a monopole antenna and a space for placement thereof. As one of these antennas, a notch antenna is known which includes a slit (a notch) in a substrate functioning as an antenna.

For example, it has been proposed a method of changing the resonant length of a notch antenna having a slit of 0.2λ, in a substrate. It has been also proposed a method of broadening the frequency band of a notch antenna having a slit of 0.25λ, in a substrate. Here, λ, represents a wavelength of a frequency used. For example, 0.2λ, corresponds to approximately 30 mm long in the 2 GHz band and to approximately 25 mm long in the 2.4 GHz band. Therefore, it seems easy to dispose the notch antenna in the mobile telephone including the substrate with a size of approximately 90 mm×approximately 45 mm. The notch antenna for a wireless mobile terminal is described, for example, in Japanese Laid-open Patent Publication Nos. 2004-032303 and 2004-056421 are examples of related art.

SUMMARY

According to an aspect of the invention, a radio apparatus includes an antenna device and a housing to which the antenna device is attached. The antenna device includes a substrate having an electrically conductive layer which includes a slit with an opening end at an end of the electrically conductive layer, and an antenna element is electrically coupled with the electrically conductive layer across the opening end via a matching circuit, and the antenna element receives an electric power through one end of the antenna element.

It is an object of the present invention to provide a space-saving antenna having an excellent characteristic. An object of the present invention is not limited to the above-described object, and may be to obtain an operational effect derived from an embodiment to be described later, that is, an operational effect that has not been achieved in the related art.

DESCRIPTION OF EMBODIMENTS (Preliminary Consideration)

However, in order to properly operate the notch antenna described above, for example, it is necessary to prevent a wiring pattern and a shield sheet metal from overlapping the slit of the notch antenna. Thus, this may result in considerable constraints on routing of wiring and placement of components disposed on the substrate. Accordingly, it is difficult to dispose the notch antenna having the slit of the above-described length in the mobile radio terminal such as a mobile telephone.

Embodiments of the present invention will be described below with reference to the accompanying drawings. The embodiments are merely examples, and there is no intention to exclude various changes and various technique-applications which will not be described in the embodiments and modifications. That is, various changes may be made to the embodiments and the modifications without departing from the scope and spirit of the present invention.

[1] First Embodiment

Figure 1:
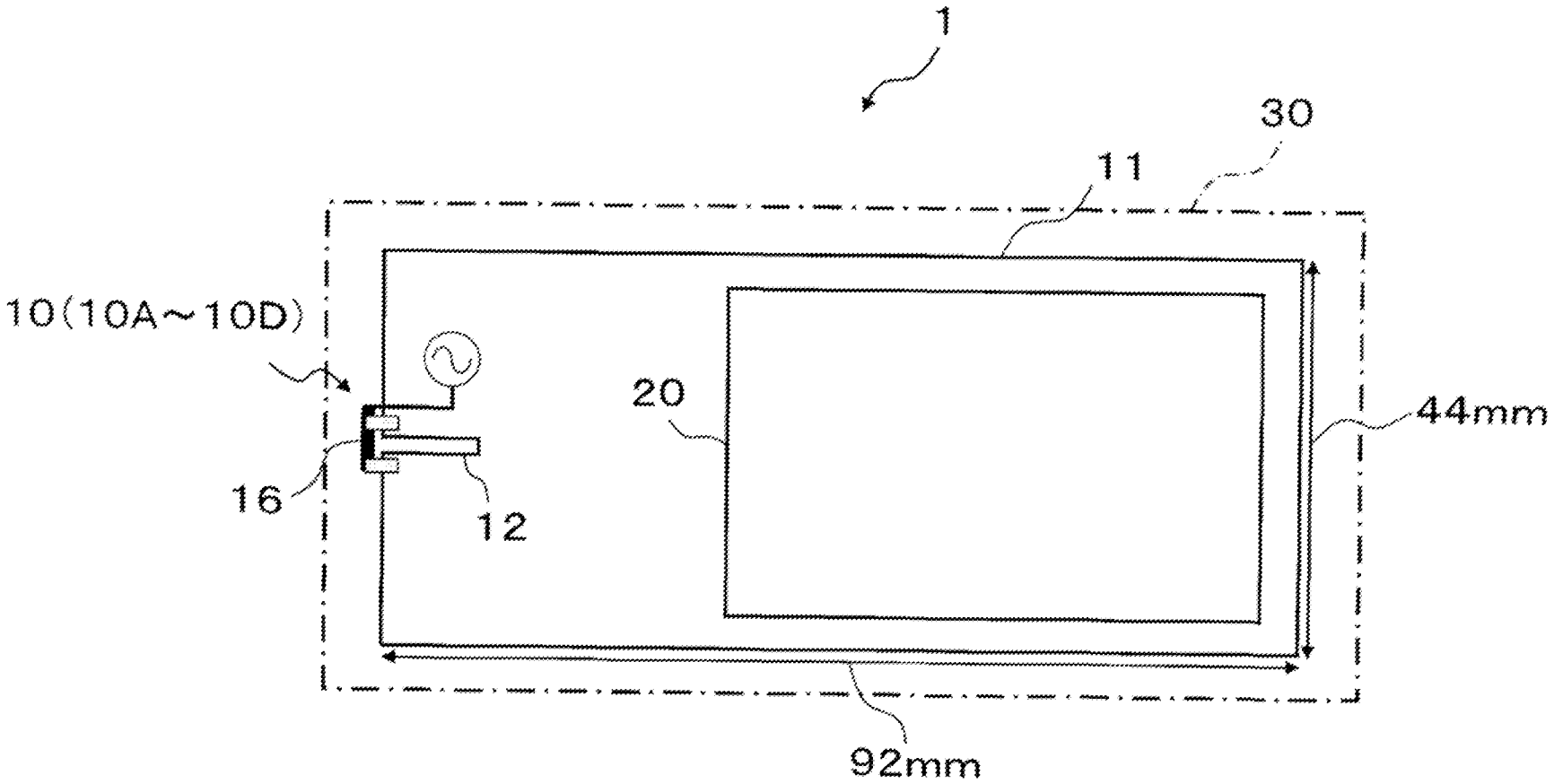
FIG. 1 is a diagram illustrating an exemplary configuration of a radio apparatus including an antenna device according to an embodiment of the present invention.
Figure 2:
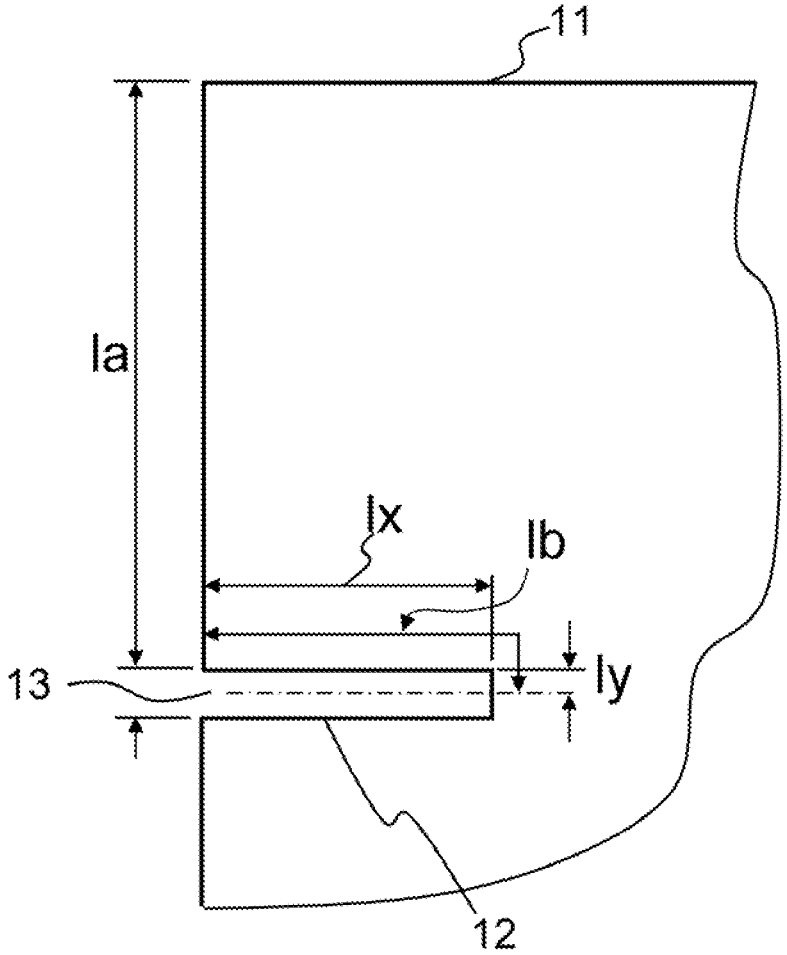
FIG. 2 is a partially enlarged view of an antenna device according to the embodiment.
Figure 3:
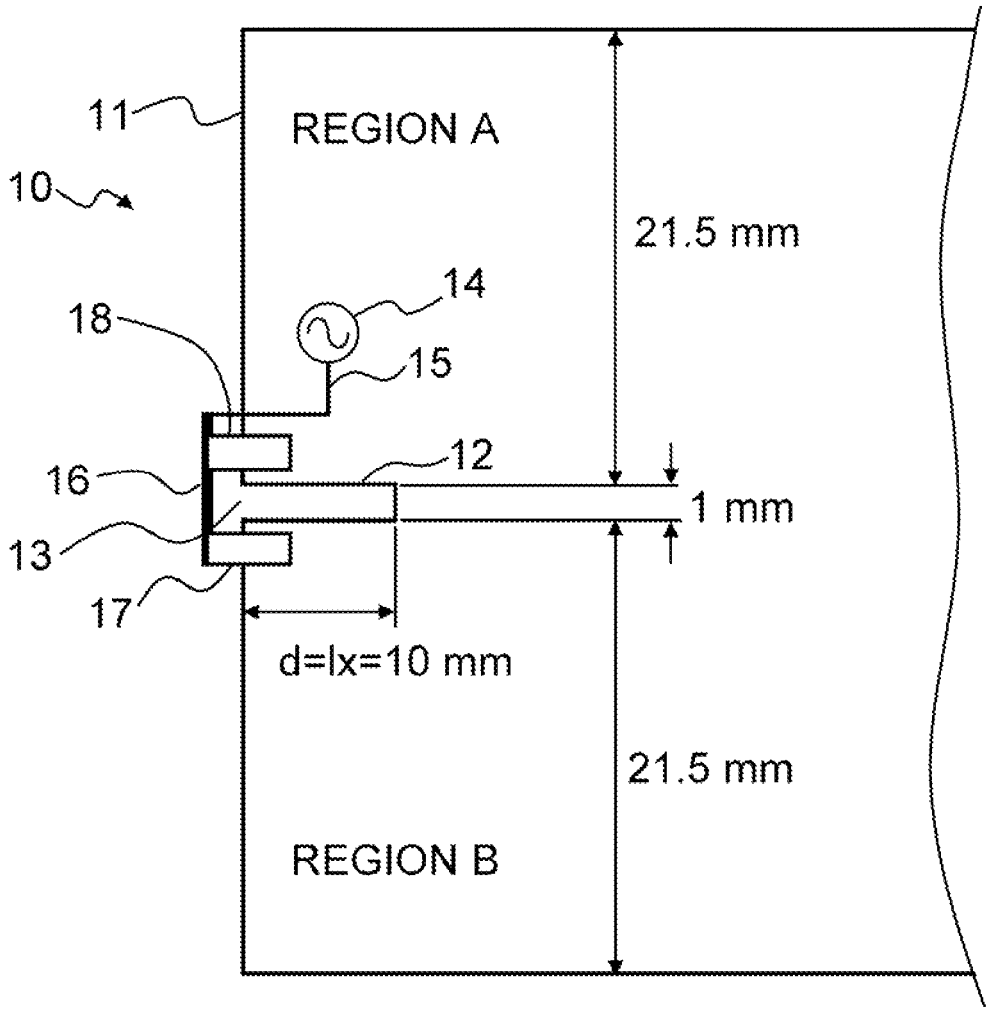
FIG. 3 is a diagram illustrating details of the antenna device illustrated in FIG. 1.

An antenna device 10 according to an embodiment of the present invention will be described with reference to FIGS. 1 to 3. FIG. 1 is a diagram illustrating an exemplary configuration of the antenna device 10. FIG. 2 is a partially enlarged view of the antenna device 10. FIG. 3 is a diagram illustrating details of the antenna device 10.

In this embodiment, the antenna device 10 is tuned to, for example, a 2-GHz receiving band (in the range of 2110 MHz to 2170 MHz) in the MIMO system. As illustrated in FIG. 1, the antenna device 10 and antenna devices 10A to 10D (described later) are used as antenna devices in a mobile radio terminal (radio apparatus) 1 such as a mobile telephone. The mobile radio terminal 1 includes the antenna device 10 (or one of the antenna devices 10A to 10D) and a housing 30 to which the antenna device 10 (or one of the antenna devices 10A to 10D) is attached. The antenna device 10 (or one of the antenna devices 10A to 10D) uses a substrate 11. On the substrate 11, a radio circuit 20 is disposed for performing radio communication processing using the antenna device 10 (or one of the antenna devices 10A to 10D).

The antenna device 10 illustrated in FIGS. 1 and 3 includes the substrate 11 in which a slit 12 is formed, a feeding element 14, a feeder 15, an antenna element 16, a capacitor 17, and an inductor 18. As illustrated in FIGS. 1 and 3, the slit 12 is a straight notch extending from the center of a side (short side) of the substrate 11 in a direction perpendicular to the side. In this example, the length d of the slit 12 (the distance of the slit 12 from an open end 13 in the substrate 11) is 10 mm (approximately 0.07λ and is much shorter than a required slit length of the conventional notch antenna. The width of the slit 12 is 1 mm.

In this embodiment, as illustrated in FIG. 2, the slit 12 is formed so that the sum l of a length la approximately half of one side of the substrate 11 at which the slit 12 is formed and a length lb half of an inner perimeter of the slit 12 lb=lx+ly becomes approximately λ/4, that is, approximately quarter of a wavelength λ, of the frequency used. More specifically, in the antenna device 10 illustrated in FIGS. 1 and 3, l=la+lx+ly=21.5 mm+10 mm+0.5 mm=32 mm is satisfied. A quarter of a wavelength λ, in 2140 MHz is approximately 35 mm. Thus, they are substantially equal.

In the above-described equations, lx represents the notch length of the slit 12 (the distance d), and ly represents half of the width of the slit 12. In the antenna device 10, the length la is smaller than half of one side of the substrate 11 by the length ly that is half of the width of the slit 12, and is not therefore half of the side of the substrate 11. That is, as described above, the length la is approximately half of one side of the substrate 11 at which the slit 12 is formed.

The configuration of the antenna device 10 illustrated in FIG. 1 will be described in detail with reference to FIG. 3. The antenna element 16 is attached to the substrate 11 so that it covers the open end 13 of the slit 12 via a matching circuit. In this embodiment, the capacitor 17 and the inductor 18 form a matching circuit. A region on the substrate 11 is divided by the slit 12 into a region A on one side of the substrate 11 (a region on the upper side in FIG. 3 in which the feeding element 14 is disposed) and a region B on the opposite side, that is a lower side of the substrate 11 as illustrated in FIG. 3.

On end of the antenna element 16 is electrically coupled to the region A in the substrate 11 via the inductor 18, and the other end of the antenna element 16 is connected to the region B in the substrate 11 via the capacitor 17. The inductor 18 is used to adjust an impedance, and does not directly affect a resonant frequency. In the embodiment, the capacitance of the capacitor 17 is 0.5 pF, and the inductance of the inductor 18 is 1.5 nH. However, the capacitor 17 and the inductor 18 may have other values.

Figure 4:
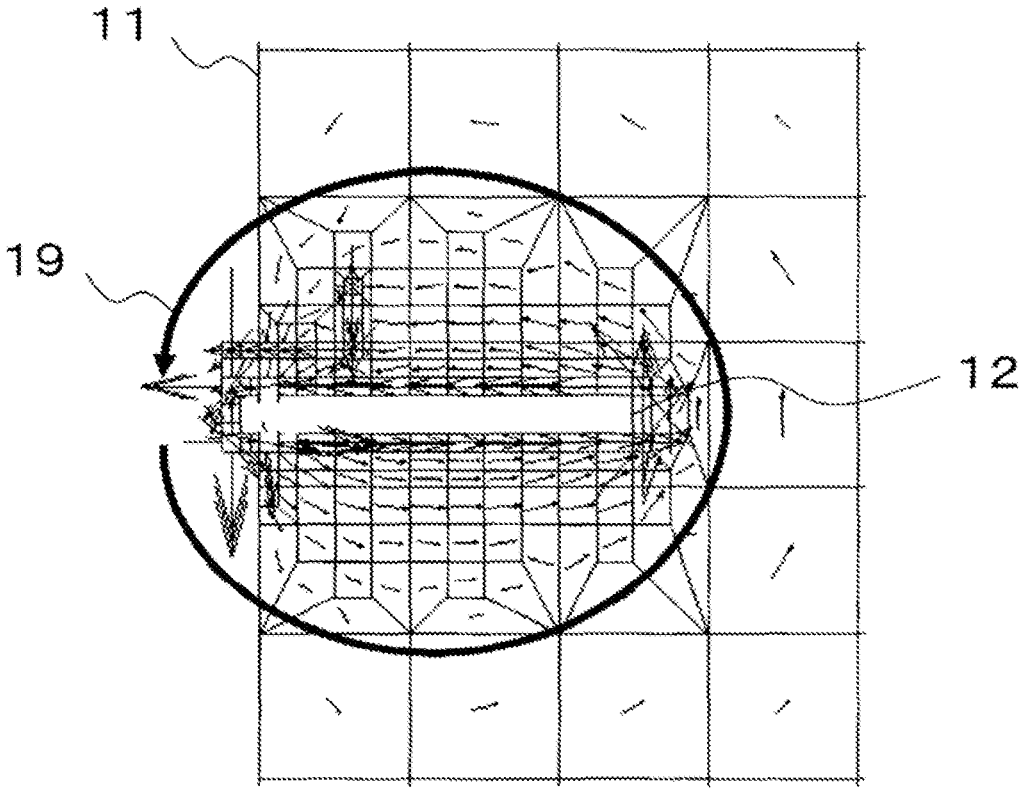
FIG. 4 is a diagram illustrating the principle of operation of the antenna device illustrated in FIG. 1.
Figure 5:
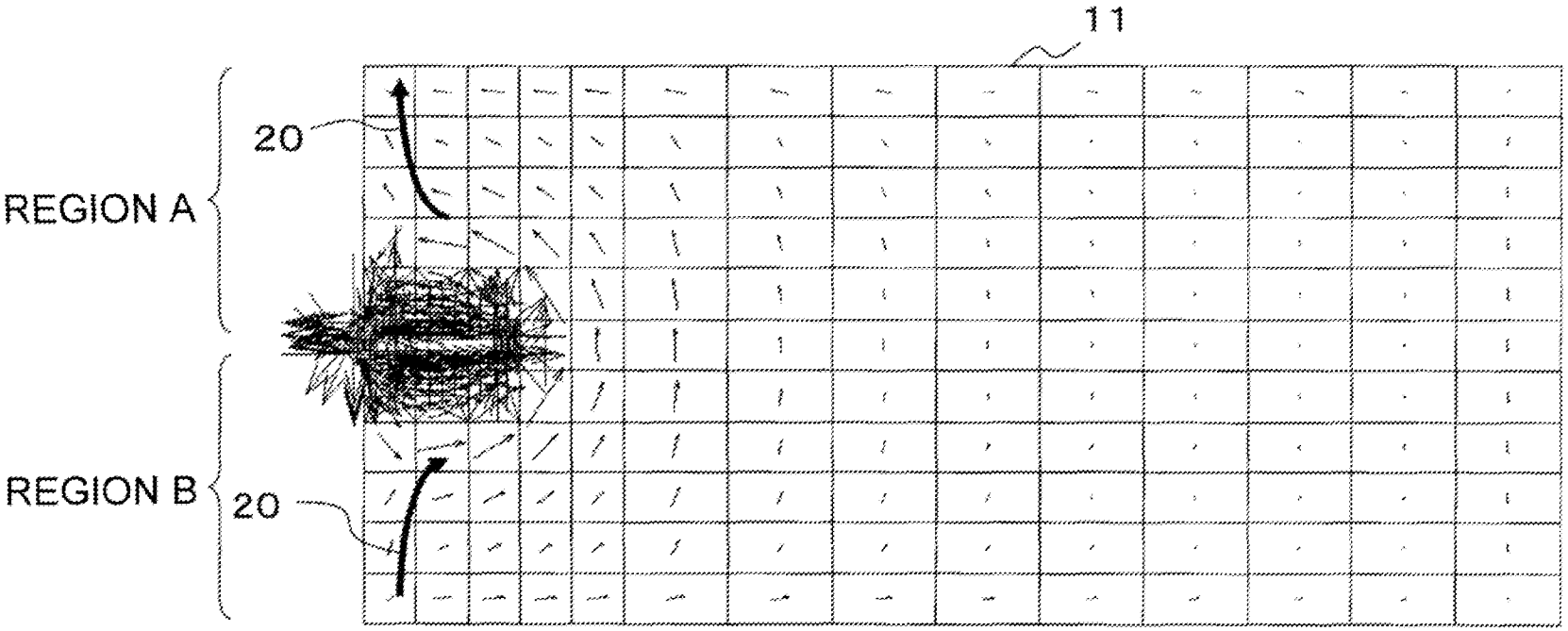
FIG. 5 is a diagram illustrating the principle of operation of the antenna device illustrated in FIG. 1.

Electric power is supplied from the feeding element 14 to one end of the antenna element 16 via the feeder 15 disposed in the region A. The principle of operation of an antenna according to this embodiment will be described with reference to FIGS. 4 and 5. FIGS. 4 and 5 are diagrams illustrating simulated current distributions on the substrate 11 in the antenna device 10 illustrated in FIG. 1 when an observation frequency is 2140 MHz.

The antenna device 10 resonates in accordance with the inductance of the inductor 18 which are changed with the inner perimeter of the slit 12 and the capacitance of the capacitor 17. The resonance of the antenna device 10 is that of a loop antenna, and an eddy current (represented by an arrow 19 in FIG. 4) is generated on the substrate 11 around the slit 12 as illustrated in FIG. 4. The eddy current induces currents (represented by arrows 20 in FIG. 5) having substantially the same direction in the regions A and B as illustrated in FIG. 5.

As described above, the sum of the approximately half length of one side of the substrate 11 and the half of the inner perimeter of the slit 12 is approximately λ/4. Accordingly, portions of the substrate 11 as the regions A and B function each as an antenna element having a length of λ/4. Therefore, one side of the substrate 11 at which the slit 12 is formed operates as a dipole antenna having a length of λ/2.

Figure 6:
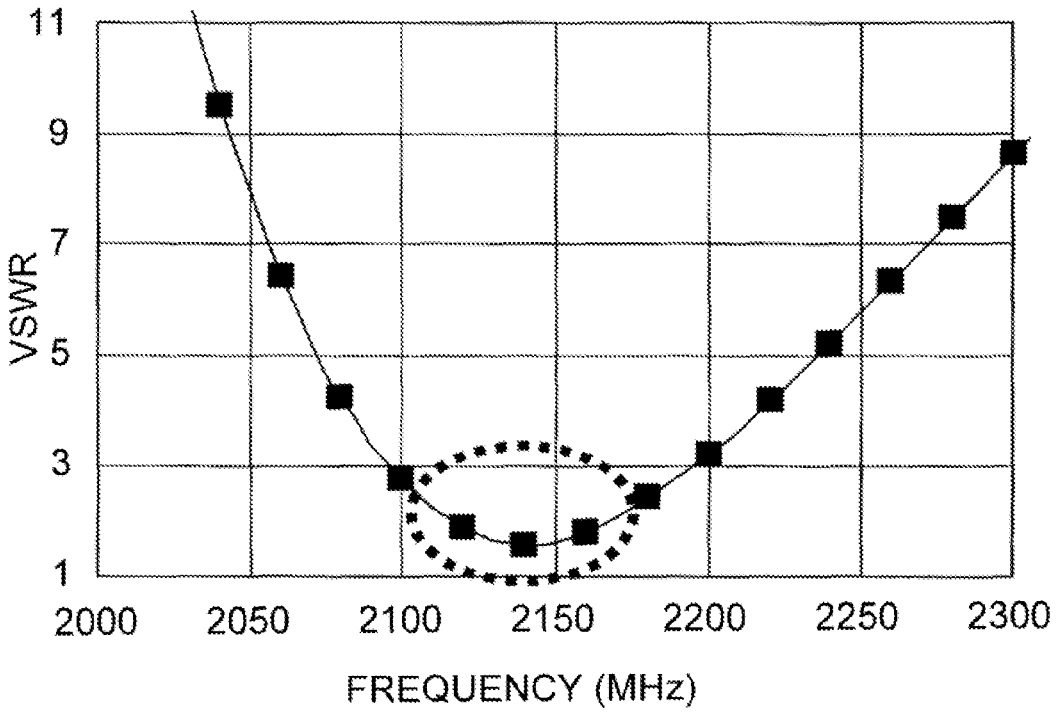
FIG. 6 is a diagram illustrating a VSWR frequency characteristic of the antenna device illustrated in FIG. 1.

FIG. 6 is a diagram illustrating a Voltage Standing Wave Ratio (VSWR) characteristic, which is obtained by simulation, of the antenna device 10 illustrated in FIG. 1. As is apparent from FIG. 6, the antenna device 10 illustrated in FIG. 1 has a VSWR equal to or smaller than 3 at a target frequency (in the range of 2110 MHz to 2170 MHz, circled by a dotted line), and exhibits a good characteristic. As described above, since one side of the substrate 11 at which the slit 12 is formed functions as an antenna element in the antenna device 10 according to the embodiment, it is possible to obtain an excellent characteristic with the slit 12 that is much shorter than a slit of a typical notch antenna.

Furthermore, since the antenna element 16 is disposed at the center of one side of the substrate 11, the antenna device 10 does not conflict with a monopole antenna for placement space when the both antennas are provided. Still furthermore, since the length of the slit 12, that is, the extension distance d of the slit 12 from the open end 13 in the substrate 11, is much shorter than that of a slit of a notch antenna, few constraints may be imposed on routing of wiring lines and placement of components on the substrate 11.

[2] First Modification

Figure 7:
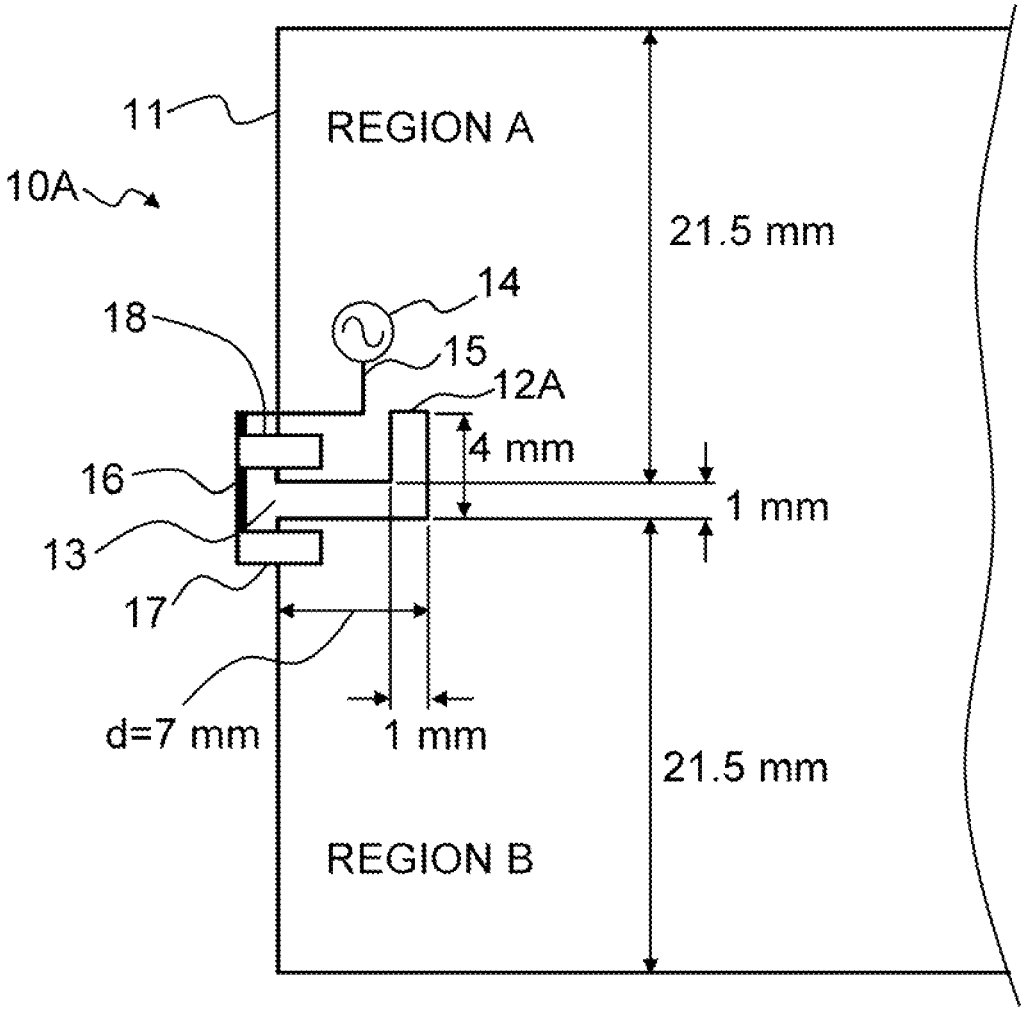
FIG. 7 is a diagram illustrating a configuration of an antenna device that is a first modification.

FIG. 7 is a diagram illustrating the first modification of an antenna device according to the embodiment of the present invention. Referring to FIG. 7, the same reference numeral is used to identify part or element already described, and the description thereof will be therefore omitted. As illustrated in FIG. 7, in the antenna device 10A that is the first modification, an L-shaped slit 12A extending upwardly from a predetermined position in the drawing is formed instead of the slit 12 illustrated in FIG. 1. The half of the inner perimeter of the slit 12A is 10.5 mm, and is equal to the length lb representing the half of the inner perimeter of the slit 12 illustrated in FIG. 3.

Figure 8:
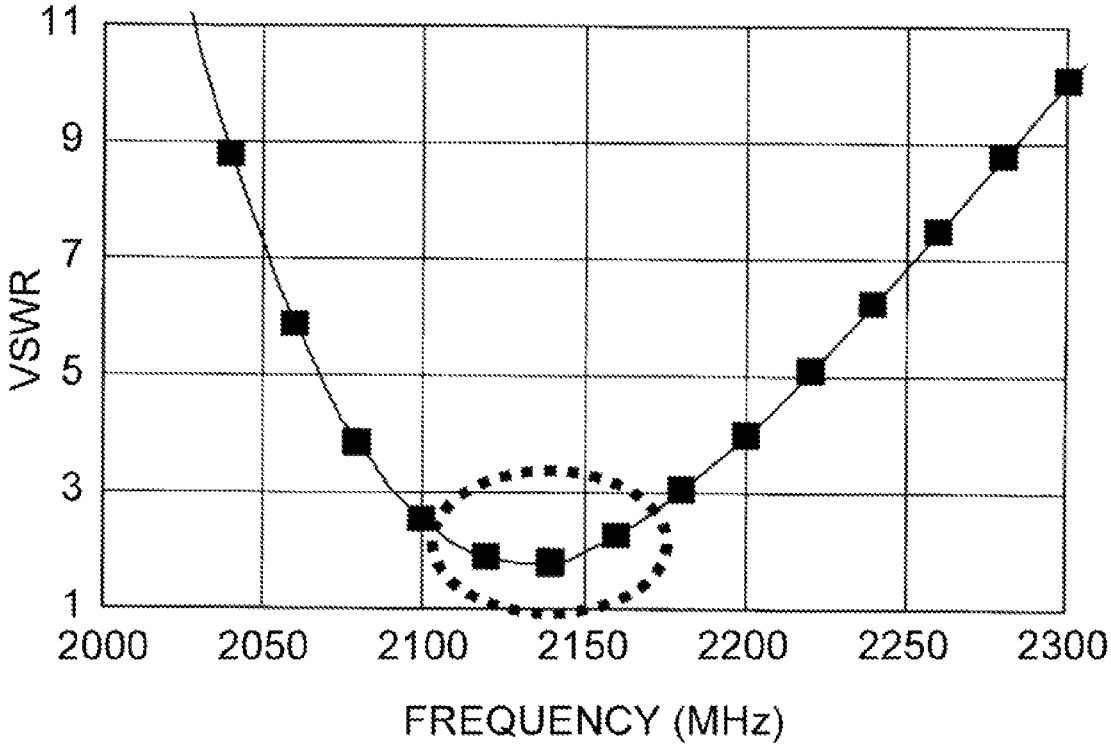
FIG. 8 is a diagram illustrating a VSWR frequency characteristic of the antenna device illustrated in FIG. 7.

FIG. 8 is a diagram illustrating a VSWR characteristic, which is obtained by simulation, of the antenna device 10A illustrated in FIG. 7. As is apparent from FIG. 8, the antenna device 10A having the slit 12A illustrated in FIG. 7 also has a VSWR equal to or smaller than 3 at a target frequency (in the range of 2110 MHz to 2170 MHz, circled by a dotted line), and exhibits a good characteristic.

Use of the antenna device 10A may provide an advantage similar to that obtained by use of the antenna device 10. Further, the antenna device 10A may provide another advantage due to decrease the extension distance d of the L-shaped slit 12A from the open end 13 in the substrate 11 even if the inner perimeter of the slit 12A equals to that of the slit 12. As a result, use of the antenna device 10A may make it possible to improve the flexibility in placing wiring and components on the substrate 11 while maintaining the good characteristic similar to that provided by the antenna device 10. More specifically, the extension distance d is 7 mm in the antenna device 10A as illustrated in FIG. 7, while the extension distance d is 10 mm in the antenna device 10.

[3] Second Modification

Figure 9:
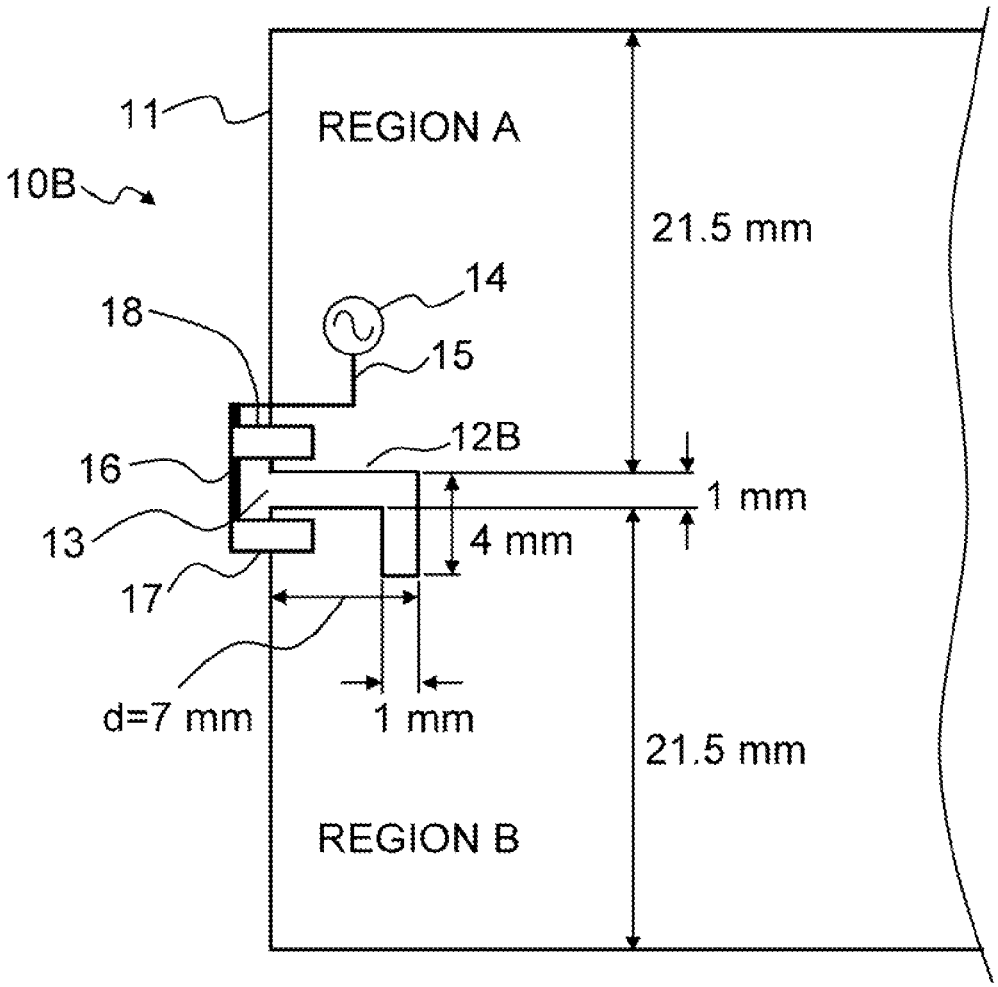
FIG. 9 is a diagram illustrating a configuration of an antenna device that is a second modification.

FIG. 9 is a diagram illustrating the second modification of an antenna device according to the embodiment of the present invention. Referring to FIG. 9, the same reference numerals are used to identify parts already described, and the description thereof will be therefore omitted. As illustrated in FIG. 9, in the antenna device 10B that is the second modification, an L-shaped slit 12B extending downwardly from a predetermined position in the drawing is formed instead of the slit 12 of the rectangular form as illustrated in FIG. 1. The half of the inner perimeter of the slit 12B is 10.5 mm, and is equal to the length lb representing the half of the inner perimeter of the slit 12.

Figure 10:
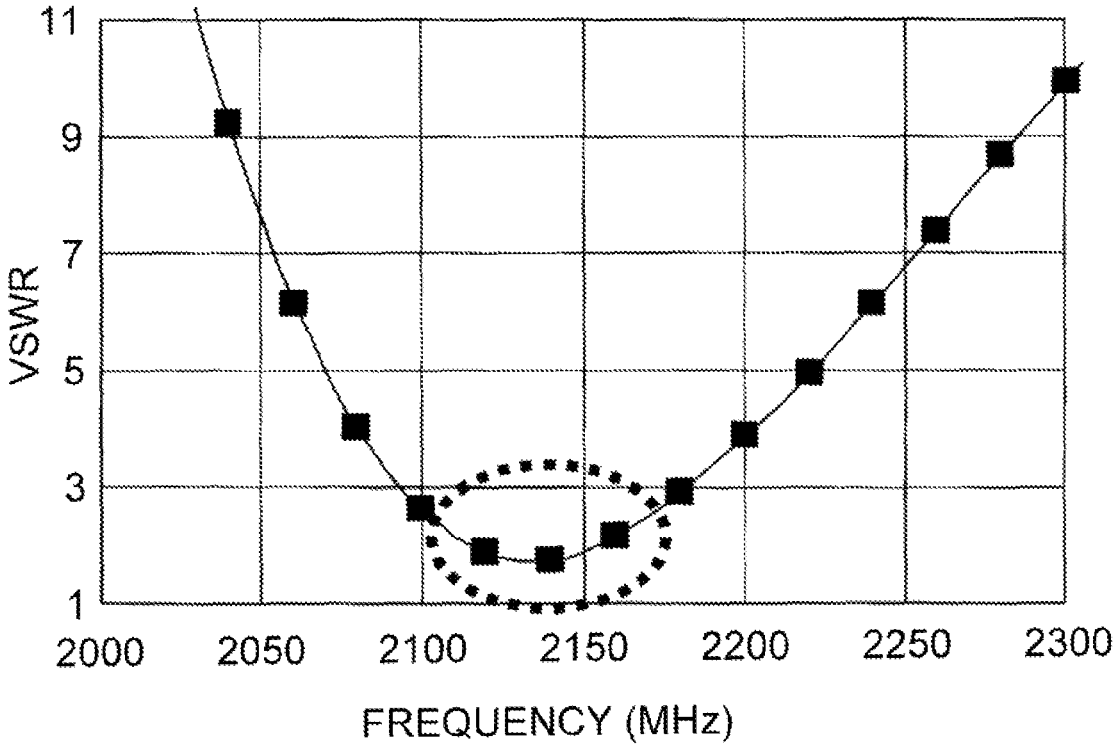
FIG. 10 is a diagram illustrating a VSWR frequency characteristic of the antenna device illustrated in FIG. 9.

FIG. 10 is a diagram illustrating a VSWR characteristic of the antenna device 10B illustrated in FIG. 9 which is obtained by simulation. As is apparent from FIG. 10, the antenna device 10B having the slit 12B illustrated in FIG. 9 also has a VSWR equal to or smaller than 3 at a target frequency (in the range of 2110 MHz to 2170 MHz), and exhibits a good characteristic.

Use of the antenna device 10B may provide an advantage similar to that obtained by use of the antenna device 10. Further, the antenna device 10B may provide another advantage, as is the case with the antenna device 10A of the first modification, due to decrease the extension distance d of the L-shaped slit 12B from the open end 13 in the substrate 11 even if the inner perimeter of the slit 12B equals to that of the slit 12. As a result, use of the antenna device 10B makes it is possible to improve the flexibility in placing wiring lines and components on the substrate 11 while maintaining a good characteristic similar to that of the antenna device 10. More specifically, the extension distance d is 7 mm in the antenna device 10B as illustrated in FIG. 9, while the extension distance d is 10 mm in the antenna device 10.

[4] Third Modification

Figure 11:
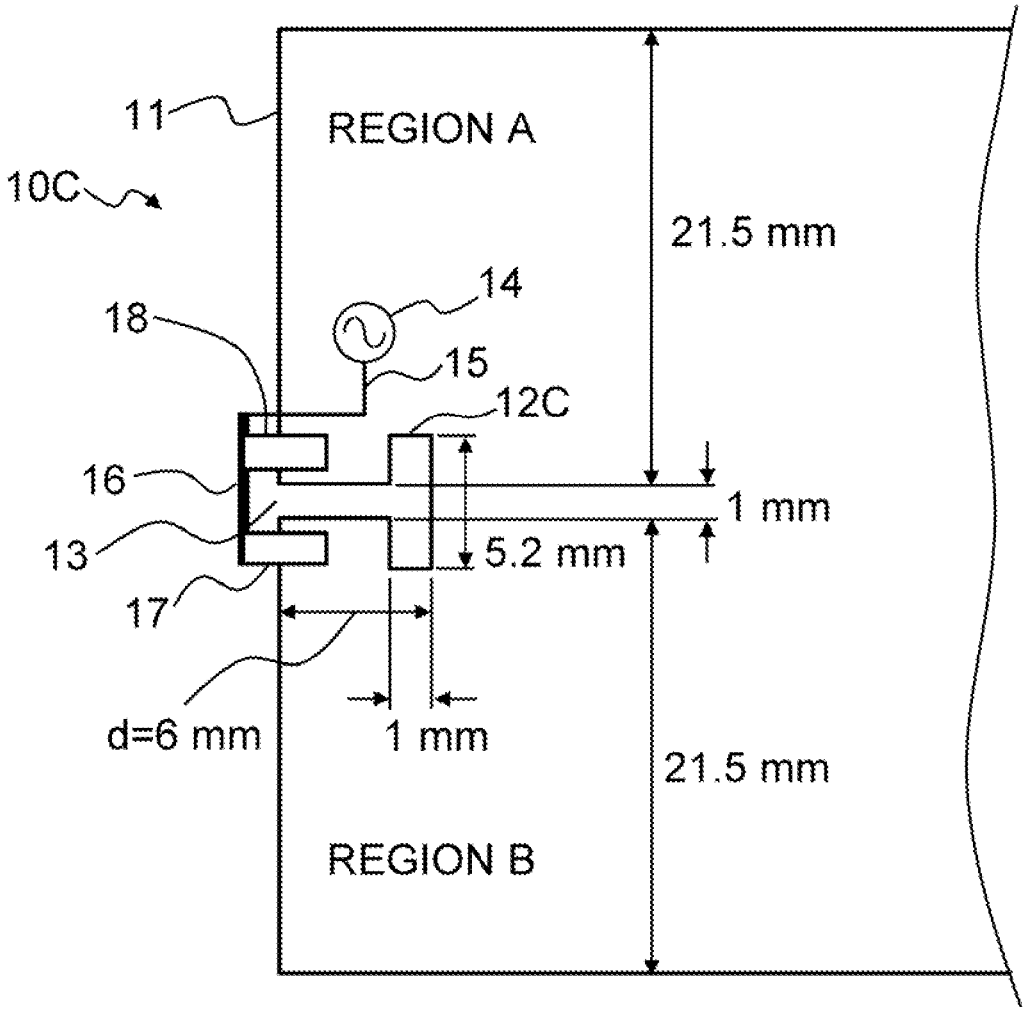
FIG. 11 is a diagram illustrating a configuration of an antenna device that is a third modification.

FIG. 11 is a diagram illustrating the third modification of an antenna device according to the embodiment of the present invention. Referring to FIG. 11, the same reference numerals are used to identify parts already described, and the description thereof will be therefore omitted. As illustrated in FIG. 11, in the antenna device 10C that is the third modification, a T-shaped slit 12C is formed instead of the slit 12 of the rectangular form as illustrated in FIG. 1. The half of the inner perimeter of the slit 12C is 10.7 mm, and is substantially equal to the length lb representing the half of the inner perimeter of the slit 12.

Figure 12:
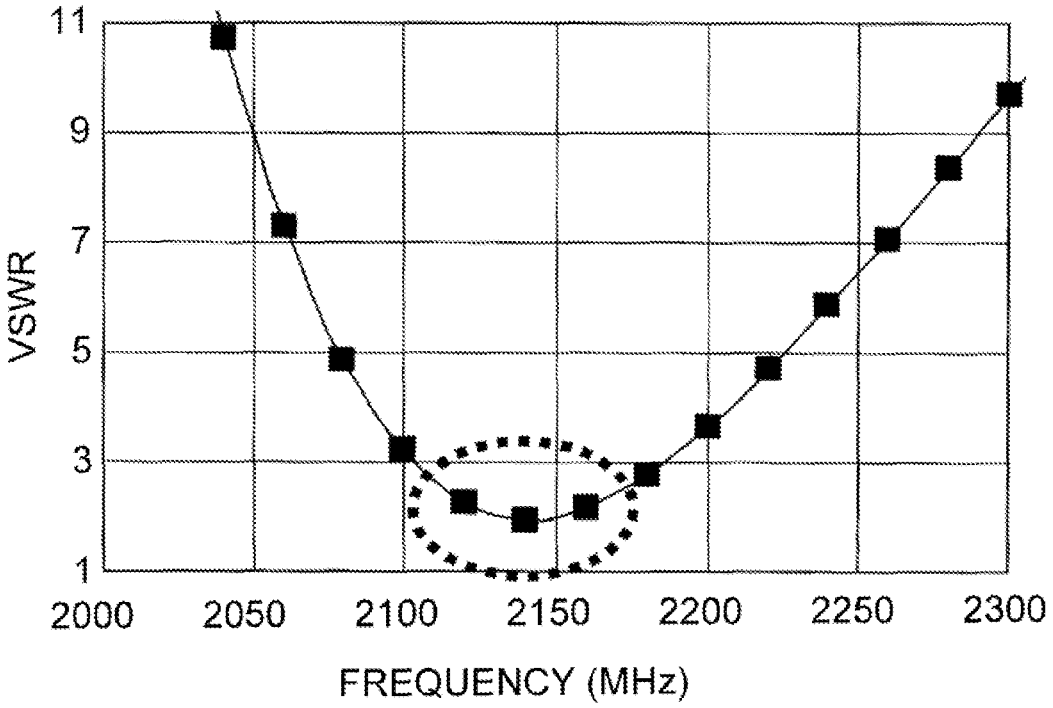
FIG. 12 is a diagram illustrating a VSWR frequency characteristic of the antenna device illustrated in FIG. 11.

FIG. 12 is a diagram illustrating a VSWR characteristic of the antenna device 10C illustrated in FIG. 11 which is obtained by simulation. As is apparent from FIG. 12, the antenna device 10C having the slit 12C illustrated in FIG. 11 also has a VSWR equal to or smaller than 3 at a target frequency (in the range of 2110 MHz to 2170 MHz), and exhibits a good characteristic.

Use of the antenna device 10C may provide an advantage similar to that obtained by use of the antenna device 10. Further, the antenna device 10C may provide another advantage, that is, the extension distance d of the slit 12C from the open end 13 may be further reduced than that of the slit 12A or 12B while making the inner perimeter of the slit 12C substantially equal to that of the slit 12. As a result, it is possible to improve the flexibility in placing wiring and components on the substrate 11 while maintaining a good characteristic similar to that of the antenna device 10. More specifically, the extension distance d is 6 mm in the antenna device 10C as illustrated in FIG. 11, while the extension distance d is 10 mm in the antenna device 10.

[5] Fourth Modification

Figure 13:
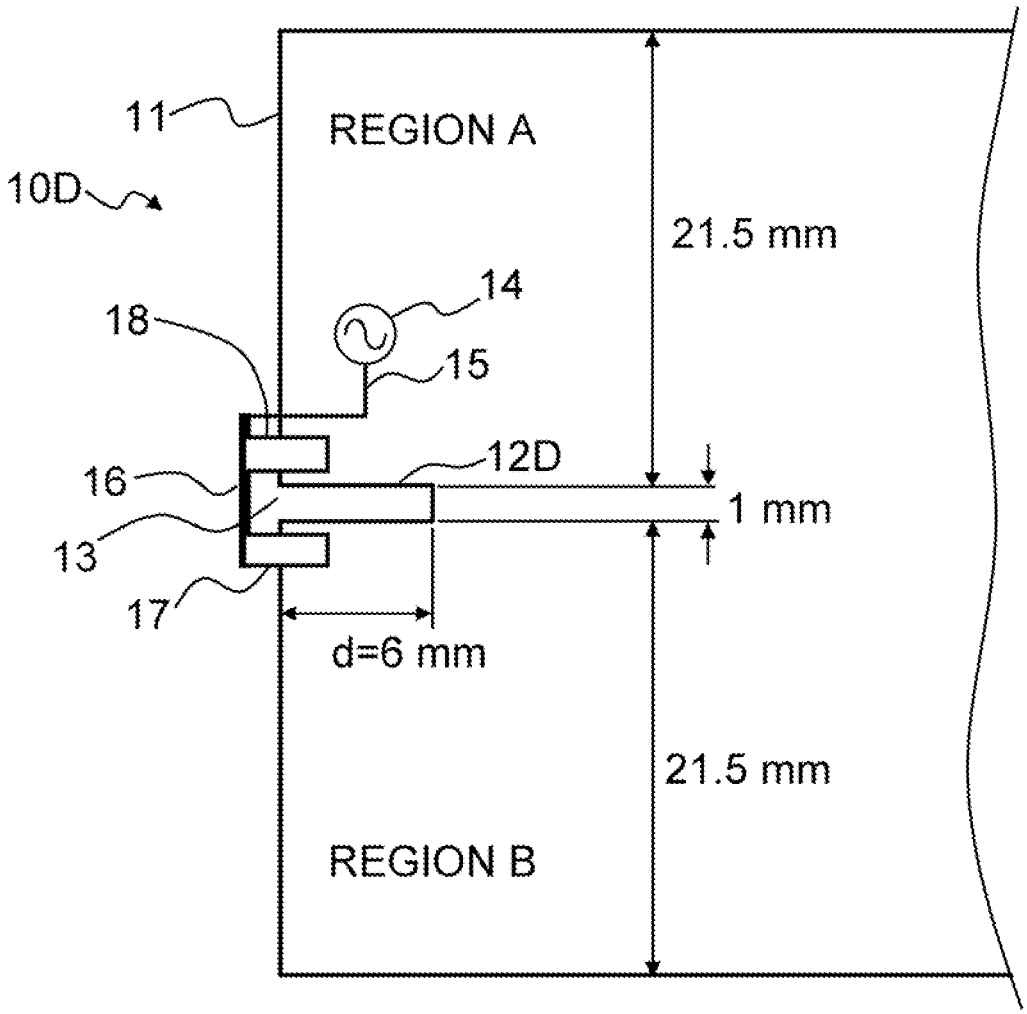
FIG. 13 is a diagram illustrating a configuration of an antenna device that is a fourth modification.

FIG. 13 is a diagram illustrating the fourth modification of an antenna device according to the embodiment of the present invention. Referring to FIG. 13, the same reference numerals are used to identify parts already described, and the description thereof will be therefore omitted. As illustrated in FIG. 13, in the antenna device 10D, a straight slit 12D is shorter than the slit 12 illustrated in FIG. 1. More specifically, the slit 12D has a notch length of lx=d=6 mm in the antenna device 10D, while the slit 12 has a notch length of lx=d=10 mm in the antenna device 10. The operating frequency of the antenna device 10D is tuned into a frequency band of 2400 MHz to 2480 MHz used for Bluetooth and a wireless LAN.

Figure 14:
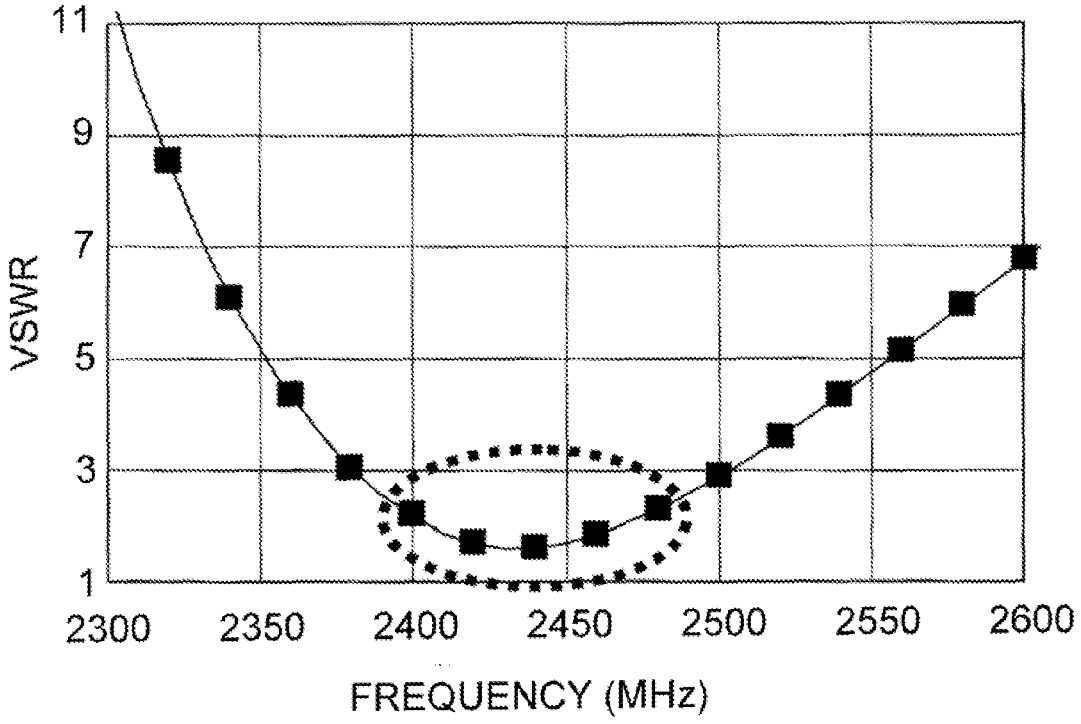
FIG. 14 is a diagram illustrating a VSWR frequency characteristic of the antenna device illustrated in FIG. 13.

As illustrated in FIG. 13, in this modification, the inner perimeter of the slit 12D is determined so that the sum of the approximately half (21.5 mm) of one side of the substrate 11 at which the slit 12D and the half (6.5 mm) of the inner perimeter of the slit 12D becomes 28 mm, and the sum is substantially equal to the quarter (approximately 30.7 mm) of a wavelength at 2440 MHz. FIG. 14 is a diagram illustrating a VSWR characteristic of the antenna device 10D illustrated in FIG. 13 which is obtained by simulation.

As is apparent from FIG. 14, the antenna device 10D having the slit 12D illustrated in FIG. 13 also has a VSWR equal to or smaller than 3 at a target frequency (in the range of 2400 MHz to 2480 MHz), and exhibits a good characteristic. Using the antenna device 10D that is the fourth modification, the same advantage as that obtained when the antenna device 10 is used may be obtained. In addition, the operating frequency of the antenna device 10D may be easily changed by changing the inner perimeter of the slit 12D formed on the substrate 11. In this modification, the operating frequency of the antenna device 10D is increased by reducing a slit length, that is, the inner perimeter of the slit. In contrast, the operating frequency of the antenna device 10D may be reduced by increasing the slit length.

The fourth modification may be combined with one of the above-described modifications. That is, in the antenna device 10D, the slit 12D may have an L shape or a T shape.

[6] Others

Although a preferred embodiment of the present invention has been described in detail above, the present invention is not limited thereto. Various changes and modifications of the embodiment may be made without departing from the spirit and scope of the present invention.

For example, the size of a substrate is 92 mm×44 mm in the above-described embodiment, but may be changed to a desired frequency. The inductor 18 having an inductance of 1.5 nH is used as a matching circuit in the above-described embodiment, but a short-circuit line may be used instead of the inductor 18. By adjusting the inductance of the inductor 18, a bandwidth in which a good VSWR characteristic is obtained may be adjusted.

The size such as a notch length or a width of a slit is not limited to the above-described size. In the above-described embodiment and the above-described modifications, rectangular, L-shaped, and T-shaped slits are used. However, slits of various shapes such as a zigzag slit and a circular slit may be used.

An antenna device according to an embodiment of the present invention is widely applicable to various radio communication apparatuses including a mobile telephone.

Figure 15:
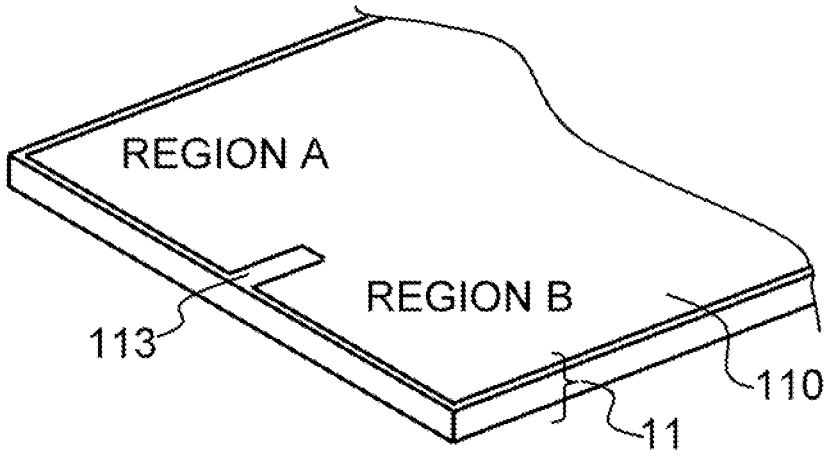
FIG. 15 is a diagram illustrating a configuration of an antenna device with a slit formed in an electrically conductive layer.
Figure 16:
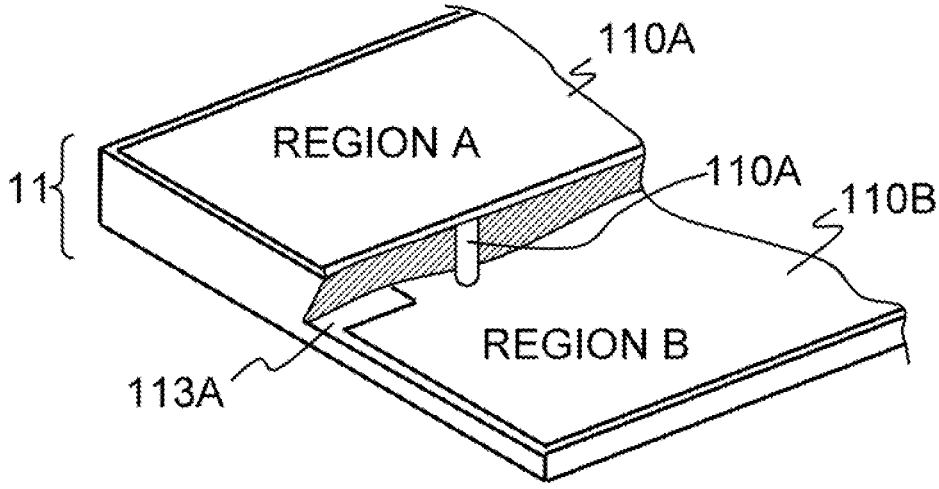
FIG. 16 is a diagram illustrating a configuration of an antenna device configured with a plurality of electrically conductive layers.

Further, as illustrated in FIG. 15, the slit 113 may be configured with only an electrical conductive layer 110 disposed on an insulating or a dielectric layer of the substrate 11, while a feeding element, a feeder, an antenna element, a capacitor, and an inductor are omitted for simplicity in FIG. 15. The slit 113 may be formed with an electrical conductive pattern. Further as illustrated in FIG. 16, the slit may be configured with several electrical conductive layers. In FIG. 16, the elements such as an antenna element are omitted for simplicity. A region A is composed of an electrical conductive layer 110A and a region B is composed of an electrical conductive layer 110B, the regions A and B are electrically coupled with each other by a through hole 120 and formed in each of layers of the substrate. An example illustrated in FIG. 16, a slit 113A is formed in the layer 110B.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A radio apparatus comprising:

an antenna device including:

a substrate including an electrically conductive layer including a slit, the slit being formed at a central portion of one of sides of the substrate, a half of a sum of a length of the one of sides and a length of an inner perimeter of the slit being approximately equal to a quarter of a wavelength corresponding to a frequency to be used, the slit forming an opening end at an end of the electrically conductive layer, and an antenna element electrically coupled with the electrically conductive layer across the opening end via a matching circuit, the antenna element receiving an electric power through one end of the antenna element; and a housing to which the antenna device is attached.

2. The radio apparatus according to claim 1, wherein the matching circuit includes, an inductor which couples electrically a first end of the antenna element with the electrically conductive layer, and a capacitor which couples electrically a second end of the antenna element with the electrically conductive layer.

3. The radio apparatus according to claim 1, wherein the matching circuit includes, an inductor which is electrically coupled between the end of the antenna element and the electrically conductive layer, and a capacitor which is electrically coupled between an other end of the antenna element and the electrically conductive layer.

4. The radio apparatus according to claim 1, wherein the slit is formed in a rectangle, an L-shaped form, or a T-shaped form.

5. The radio apparatus according to claim 2, wherein the slit is formed in a rectangle, an L-shaped form, or a T-shaped form.

6. The radio apparatus according to claim 3, wherein the slit is formed in a rectangle, an L-shaped form, or a T-shaped form.

7. The radio apparatus according to claim 1, wherein the electrically conductive layer is composed of a plurality of electrically sub-conductive layers which are electrically coupled each other.

8. The radio apparatus according to claim 1, wherein the slit is constant in a width perpendicular to a longitudinal direction of the slit.

9. The radio apparatus according to claim 1, wherein a sum of a length from a side of the electrically conductive layer to a center of the slit and a half of a width of the slit substantially equals to a quarter of a wavelength to be used.

10. An antenna device comprising:

a substrate including an electrically conductive layer which includes a slit, the slit being formed at a central portion of one of sides of the substrate, a half of a sum of a length of the one of sides and a length of an inner perimeter of the slit being approximately equal to a quarter of a wavelength corresponding to a frequency to be used, the slit including an opening end;

an antenna element electrically coupled with the electrically conductive layer across the opening end and receiving electric power at an end of the antenna element.

11. The antenna device according to claim 10, wherein the slit is constant in a width perpendicular to a longitudinal direction of the slit.

12. The antenna device according to claim 10, wherein a sum of a length from a side of the electrically conductive layer to a center of the slit and a half of a width of the slit substantially equals to a quarter of a wavelength to be used.

* * * * *